US007241115B2

(12) United States Patent
Luongo et al.

(10) Patent No.: US 7,241,115 B2
(45) Date of Patent: Jul. 10, 2007

(54) METHODS AND APPARATUS FOR DETERMINING THE PRESENCE OR ABSENCE OF A FLUID LEAK

(75) Inventors: Joseph A. Luongo, Walpole, MA (US); Steven J. Ciavarini, Natick, MA (US); Robert Q. Tacconi, Medfield, MA (US); Frank A. Rubino, North Attleboro, MA (US); Robert J. Dumas, Upton, MA (US)

(73) Assignee: Waters Investments Limited DE (US)

( * ) Notice: Subject to any disclaimer, the term of this patent is extended or adjusted under 35 U.S.C. 154(b) by 588 days.

(21) Appl. No.: 10/645,082

(22) Filed: Aug. 21, 2003

(65) Prior Publication Data

US 2005/0147508 A1 Jul. 7, 2005

(51) Int. Cl.
*F04B 49/00* (2006.01)
*G01M 3/04* (2006.01)
*G08B 21/00* (2006.01)

(52) U.S. Cl. ..... 417/53; 417/63; 73/40; 340/605

(58) Field of Classification Search ..... 417/53, 417/63; 73/40, 37, 1.68, 1.59, 864.35, 864.16, 73/864.87, 864.84; 340/605, 611
See application file for complete search history.

(56) References Cited

U.S. PATENT DOCUMENTS

| | | | | |
|---|---|---|---|---|
| 3,100,986 A | | 8/1963 | Starr et al. | |
| 4,715,214 A | | 12/1987 | Tveter | 73/49 |
| 4,901,751 A | | 2/1990 | Story | 137/312 |
| 4,927,411 A | | 5/1990 | Pastrone et al. | |
| 5,000,664 A | * | 3/1991 | Lawless et al. | 417/63 |
| 5,112,196 A | * | 5/1992 | Schuh | 417/63 |
| 5,336,053 A | | 8/1994 | Wynkoop | 417/53 |
| 5,383,351 A | | 1/1995 | Kotlyar | 73/40 |
| 5,439,355 A | | 8/1995 | Jimison | 417/63 |
| 5,631,632 A | | 5/1997 | Nakashima | 340/611 |
| 5,770,794 A | | 6/1998 | Davey | 73/37 |
| 5,817,925 A | | 10/1998 | Cook | 123/520 |
| 6,055,851 A | | 5/2000 | Tanaka | 73/46 |
| 6,094,970 A | | 8/2000 | Sprenger | 73/40 |

FOREIGN PATENT DOCUMENTS

WO WO 02/086437 10/2002

* cited by examiner

*Primary Examiner*—Charles G. Freay
(74) *Attorney, Agent, or Firm*—Anthony J. Janiuk

(57) ABSTRACT

Embodiments of the present invention feature a method and apparatus for detecting defects, such as, leaks, component failure and adverse performance. One embodiment of the present apparatus for pumping fluid comprises a pumping chamber having an inlet and an outlet powered by a motor. The motor operates in pumping mode upon receiving a pumping signal. The apparatus further comprises at least one inlet valve in fluid communication with the inlet of the pumping chamber. And, the apparatus comprises a switchable valve in fluid communication with the outlet of the pumping chamber. The switchable valve has a closed position and an open position, and assumes the closed position upon receiving a close signal. A pressure measuring device is in fluid communication with the pumping chamber, between said inlet valve and switchable valve. The pressure measuring device determines a minimal pressure and first threshold pressure at a first time and a second threshold pressure at a second time. The control means calculates the slope of a line representing the difference of said first threshold pressure signal and said second threshold pressure signal over time and comparing the slope with a threshold decay value. And, the control means compares the minimal pressure to a minimal acceptable value. Deviations from such values represent a defect in the pump.

56 Claims, 3 Drawing Sheets

METHODS AND APPARATUS FOR DETERMINING THE PRESENCE OR ABSENCE OF A FLUID LEAK

CROSS REFERENCE TO RELATED APPLICATIONS

This application claims priority from PCT Application PCT/US02/06540 filed Mar. 1, 2002, which claimed priority from U.S. Provisional Application No. 60/272,934, filed Mar. 2, 2001. The contents of these applications are incorporated herein by reference.

FIELD OF THE INVENTION

This invention relates to analytical and diagnostic instruments in which a pump induces a flow of fluid. Embodiments of the present method and apparatus determine the presence or absence of a leak by placing a fluid under pressure by operating a pump and measuring the pressure in a conduit over time. The decay of the pressure over time is compared to a predetermined rate of decay. A rate of decay greater than the threshold value suggests a leak in the hydraulic components under pressure including conduits, fittings, seals, valves or pump components. The measurement of decay over time can be compared to the threshold value or dynamic threshold values as the instrument is operated. Embodiments of the present invention have special application with respect to multi-chambered pumps. Each pump chamber can be used to place a fluid under pressure with different conduits, valves and seals.

BACKGROUND OF THE INVENTION

By way of background, the following terms will be used in this application with the meaning ascribed thereto.

The term "component defect" is used to mean that the apparatus can not attain or maintain a normal set point. In the context of a pump, a common component defect is often a leak but also encompasses the failure of sensing devices such as transducers or computing devices. As used herein, the term "leak" refers to a hole, crack or opening through which fluid escapes in a manner not intended by the user. The leak may be totally internal. That is, the fluid escapes from an area of high pressure to an area of low pressure within the apparatus. Or, such leak may be external, allowing fluid to escape from the confines of the hydraulic circuit. Leaking flammable fluids represent a safety concern, the detection of which would be very useful.

The term "solution failure" is used to suggest an absence of fluid, gases in solution or a partial filling of the pump assembly with fluid.

A "pump" is a mechanical device for moving fluids. Embodiments of the present invention have particular application to high pressure pumps used in analysis and diagnostics. By way of example, without limitation, pumps used in high performance liquid chromatography are capable of placing a fluid under as much as 10,000 psi. Such pumps can be single chamber pumps or multi-chambered pumps. One common multi-chambered pump is a serial pump in which a plurality of, usually two, pumping chambers are placed in series. That is, the flow of fluid first passes through a first pump chamber and then a second pump chamber. Another common multi-chambered pump is a parallel pump in which a plurality of, usually two, pumping chambers are placed in parallel. That is, fluid is received by a first chamber, which chamber brings the fluid to pressure and propels such fluid downstream without involving a further pump chamber. As the first pump chamber is exhausted, a second pump chamber starts to propel fluid. Parallel pumps are often equipped with rotary valves which control the outflow of the plurality of pump chambers.

As used herein, the term "control means" means control circuitry and/or computer programmable unit (CPU).

As used herein, "pressure measuring device" comprise any device for measuring pressure, including strain gauges and pressure transducers.

Valves are devices for closing, opening or directing fluid flow. Typical valves include such mechanical check valves and active valves. Mechanical check valves are responsive to pressure. Active valves receive a signal which directs power means, such as motors, solenoids and the like, to open or close the valve. Cycling valves are capable of selectively opening and closing the flow of fluid from one or more sources or directing the flow to one or more destinations. Cycling valves are used in parallel pumps to alternate the outlet flow from multiple pump chambers.

Current techniques require manual intervention to determine the integrity of a hydraulic system. It would be advantageous to have methods and apparatus capable performing operations which determine the presence or absence of a leak in a hydraulic system under pressure. Such methods and apparatus would be able to ascertain a problem in a system and alert the operator, or shut the operation down until the problem can be remedied.

SUMMARY OF THE INVENTION

Embodiments of the present invention feature methods and apparatus which facilitate the detection of leaks, solution failures and poor performance of various components of a pump. One embodiment of the present invention is a pumping apparatus for pumping fluid. The pumping apparatus comprises at least one pumping chamber having an inlet and an outlet. The pumping chamber has a piston for movement in the chamber which piston propels the fluid from the chamber. The inlet is for receiving fluid from a fluid supply and the outlet is for discharging the fluid from the chamber. At least one motor powers the piston in the pumping chamber. The motor operates in pumping mode upon receiving a pumping signal. At least one inlet valve is in fluid communication with the inlet of the pumping chamber. The inlet valve has an open position and a closed position. At least one switchable valve is in fluid communication with the outlet of the pumping chamber. The switchable valve has a closed position and an open position. The switchable valve assumes a closed position upon receiving a close signal. At least one first pressure measuring device is in fluid communication with the pumping chamber, between the inlet valve and switchable valve. The pressure measuring device produces a pressure signal in response to pressure. The apparatus further comprises control means for receiving the pressure signal, for sending a close signal to the switchable valve and for sending a pumping signal to the motor. The control means has a test mode in which the control means sends a pumping signal to the motor, sends a close signal to the switchable valve to cause the fluid in the pump chamber to be placed under a pressure. Preferably, the first pressure measuring device determines a minimal pressure at a first time and sends a minimal pressure signal to the control means. Preferably, the control means compares the minimal pressure with a minimal acceptable value. The minimal acceptable value represents a value which is related to acceptable pump performance and the presence of solution. Failure to attain such minimal acceptable value suggests a defect in the pump or solution failure. Preferably, the first pressure measuring device determines at least one first threshold pressure at a first threshold time and sends a first threshold pressure signal to the control means. And, the first pressure measuring device determines at least one second threshold pressure at a second time and sends a second threshold pressure signal to the control means. The control means calculates the slope of a line representing the difference of the first threshold pressure signal and the second threshold pressure signal over time and compares the slope with a threshold decay value. The threshold decay value represents a leak in the pump or a defect in the apparatus. The control means sends one or more error messages to the operator in response to the slope exceeding the threshold decay value or not attaining the minimal acceptable value.

The error message may be in the form of a message placed on a monitor associated with control means or the control means may turn off or render the apparatus non-functional until leaks or under-performing components are replaced or repaired.

As used herein, control means may take the form of circuitry or more preferably, one or more computer programmable units (CPUs) with appropriate software.

Preferably, the apparatus further comprises a check valve interposed in fluid communication between the pump chamber and the switchable valve.

Preferably, the apparatus has a start up mode in which the control means is turned on and the control means engages the test mode upon start up, to test for leaks and acceptable pump performance.

Embodiments of the apparatus may have more than one pumping chamber. One of the apparatus further comprises two pump chambers, a first pump chamber and a second pump chamber in series. That is, the first pump chamber receives fluid from a fluid supply and is in fluid communication with the second chamber. The second chamber discharges the fluid to the switchable valve. At least one check valve is interposed in fluid communication with the first pump chamber and the second pump chamber.

Preferably, the apparatus with two pump chambers comprises two motors, a first motor mechanically linked to the first pump chamber and a second motor mechanically linked to the second pump chamber. And, in the test mode the control means sends a signal to the first motor and second motor.

Preferably, in the test mode the control means sends a pumping signal to the second motor, sends a close signal to the switchable valve to cause the fluid in the second chamber to be placed under a pressure. The first pressure measuring device determines at least one minimal pressure at a first time and sends a first pressure signal to the control means. Preferably, the control means compares the minimal pressure with a minimal acceptable value. The minimal acceptable value represents a value which is related to acceptable pump performance. Failure to attain such minimal acceptable value suggests a defect in the pump. Preferably, the first pressure measuring device determines at least one first threshold pressure at a first time and a second threshold pressure at a second time, and sends a first threshold pressure signal and a second threshold pressure signal to the control means. The control means calculates the slope of a line representing the difference of the first threshold pressure signal and the second threshold pressure signal over time and compares the slope with a threshold decay value, where the threshold decay value represents a defect in the pump. The control means sends one or more error messages to the operator in response to the slope exceeding the threshold decay value or in response to failure to attain the minimal acceptable value indicating one or more leaks in the check valve or the pump apparatus in fluid communication with the second pump chamber under pressure or other defect.

Preferably, in the alternative or in addition, in the test mode the control means sends a pumping signal to the first motor, sends a close signal to the switchable valve to cause the fluid in the first chamber to be placed under a pressure. The first pressure measuring device determines at least one minimal pressure and sends a minimal pressure signal to the control means. Preferably, the control means compares the minimal pressure with a minimal acceptable value. The minimal acceptable value represents a value which is related to acceptable pump performance. Failure to attain such minimal acceptable value suggests a defect in the pump. Preferably, the first pressure measuring device determines at least one first threshold pressure at a first time and a second threshold pressure at a second time. The first pressure measuring device sends a first pressure signal and a second pressure signal to the control means. The control means calculates the slope of a line representing the difference of the first pressure signal and the second pressure signal over time and compares the slope with a threshold decay value, which threshold decay value represents a defect in the pump. The control means sends one or more error messages to the operator in response to the slope exceeding the threshold decay value or in response to failure to attain the minimal acceptable value indicating one or more defects in the pump, such as, leaks in the inlet valve or the pump apparatus in fluid communication with the first pump chamber under pressure.

Preferably, the apparatus of further comprises a second pressure measuring device interposed in fluid communication between the first pump chamber and the check valve. In the test mode the control means sends a pumping signal to the first motor, to cause the fluid in the first chamber to be placed under a pressure. The second pressure measuring device determines at least one first minimal pressure and sends a minimal pressure signal to the control means. Preferably, the control means compares the minimal pressure with a minimal acceptable value. The minimal acceptable value represents a value which is related to acceptable pump performance. Failure to attain such minimal acceptable value suggests a defect in the pump or solution failure. Preferably, the second pressure measuring device determines at least one first threshold pressure at a first time and a second threshold pressure at a second time. The second pressure measuring device sends a first threshold pressure signal and sends a second threshold pressure signal to the control means. The control means calculates the slope of a line representing the difference of the first threshold pressure signal and the second threshold pressure signal over time and compares the slope with a threshold decay value, which threshold decay value represents a defect in the pump. The control means sends one or more error messages to the operator in response to the slope exceeding the threshold decay value or in response to failure to attain the minimal acceptable value indicating one or more defects in the pump, such as, leaks in the inlet valve or check valve or the pump apparatus in fluid communication with the first pump chamber under pressure.

Preferably, the control means receives a first set of pressure values from the first pressure measuring device and a second set of pressure values from the second pressure measuring device and compares the values to determine errors in the performance of the pressure measuring devices or leaks in the apparatus or defects in the pump.

Embodiments of the present invention are useful in pumps having a parallel configuration. One embodiment comprises as apparatus further comprising two pump chambers, two inlet valves and two outlet valves and a switchable valve. The pump chambers comprise a first pump chamber and a second pump chamber. The first pump chamber and second pump chamber are in parallel with the first pump chamber receiving fluid from a fluid supply via a first inlet valve and the second pump chamber receiving fluid from a fluid supply via a second inlet valve. The first pumping chamber discharges fluid via a first outlet check valve and the second pumping chamber discharges fluid via a second outlet check valve. The first outlet check valve and the second outlet check valve are in fluid communication with a switchable valve.

Preferably, the apparatus further comprises two pressure measuring devices and two motors. The motors comprise a first motor mechanically linked to the first pump chamber and a second motor mechanically linked to the second pump chamber. The two pressure measuring devices comprise a first pressure measuring device and a second pressure measuring device. The first pressure measuring device is interposed in fluid communication between the first pumping chamber and the first check valve and the second pressure measuring device is interposed in fluid communication between the second pumping chamber and the second check valve. The two pressure measuring devices allow the first pump chamber and the second pump chamber to be placed in test mode independent of each other.

Preferably, in the test mode, the control means directs one of the motors to go into pumping mode which places one of the first or second pump chamber under pressure and such apparatus in fluid communication with the pump chamber under pressure through to the opposite check valve. In this manner, the outlet check valve of the opposite pump chamber can be tested in a parallel pump. And, of course, in the test mode, first one motor of one pump chamber is placed in pump mode and then the opposite motor of the opposite pump chamber is placed in pump mode to allow testing of both outlet check valves.

Preferably, the control means receives a first set of pressure values from the first pressure measuring device and a second set of pressure values from the second pressure measuring device and compares the values. Differences in the values suggest errors in the performance of the pressure measuring devices, the first or second pump chambers, the first and second inlet valves or the outlet check valves. The values may also be compared to minimal acceptable values and threshold decay values.

A further embodiment of the present invention features a method of testing the performance of a pumping apparatus for pumping fluid. The method comprising the steps of providing a pumping apparatus having at least one pumping chamber having an inlet and an outlet. The pumping chamber has a piston for movement in the chamber which piston propels the fluid from the chamber. The inlet receives fluid from a fluid supply and the outlet for discharges the fluid from the chamber. At least one motor for powering the piston in the pumping chamber, the motor operating in pumping mode upon receiving a pumping signal. At least one inlet valve is in fluid communication with the inlet of the pumping chamber. The inlet valve has an open position and a closed position. At least one switchable valve is in fluid communication with the outlet of the pumping chamber. The switchable valve has a closed position and an open position, and assumes the closed position upon receiving a close signal. At least one first pressure measuring device is in fluid communication with the pumping chamber, between the inlet valve and switchable valve. The pressure measuring device produces a pressure signal in response to pressure. Control means, for receiving the pressure signal, for sending a close signal to the at least one switchable valve and for sending a pumping signal to the motor, has a test mode. In the test mode, the control means sends a pumping signal to the motor, sends a close signal to the switchable valve to cause the fluid in the chamber to be placed under a pressure. Peferably, the first pressure measuring device determines at least one minimal pressure and sends a first pressure signal to the control means. The control means compares the minimal pressure with a minimal acceptable value. The minimal acceptable value represents a value which is related to acceptable pump performance. Failure to attain such minimal acceptable value suggests a defect in the pump or solution failure. Preferably, the first pressure measuring device determines at least one first threshold pressure at a first time and a second threshold pressure at a second time. The pressure measuring device sends the first threshold pressure signal and the second threshold pressure signal to the control means. The control means calculates the slope of a line representing the difference of the first threshold pressure signal and the second threshold pressure signal over time and compares the slope with a threshold decay value, representing a defect in the pump. The control means sends one or more error messages to the operator in response to the slope exceeding the threshold decay value or the pump failing to attain the minimal acceptable value. The method further comprises the step of operating the apparatus in test mode.

Preferably, the apparatus has a start up mode in which the control means in turned on and the control means engages the test mode upon start up to test for defects.

In a series configuration, with two pump chambers, comprising a first pump chamber and a second pump chamber, the first pump chamber receives fluid from a fluid supply and is in fluid communication with the second chamber. The second chamber discharges the fluid to the switchable valve. At least one check valve is interposed in fluid communication with the first pump chamber and the second pump chamber. Preferably, the apparatus further comprises two motors, a first motor mechanically linked to the first pump chamber and a second motor mechanically linked to the second pump chamber. In the test mode, the control means sends a signal to the first motor and second motor.

And, in the test mode, the control means sends a pumping signal to the second motor, and sends a close signal to the switchable valve to cause the fluid in the second chamber to be placed under a pressure. The first pressure measuring device determines at least one minimal pressure at a first time and sends a minimal pressure signal to the control means. Preferably, the control means compares the minimal pressure with a minimal acceptable value. The minimal acceptable value represents a value which is related to acceptable pump performance. Failure to attain such minimal acceptable value suggests a defect in the pump or solution failure. Preferably, the first pressure measuring device determines at least one first threshold pressure at a first time and a second threshold pressure at a second time. The first pressure measuring device sends a first threshold pressure signal and a second threshold pressure signal to the control means. The control means calculates the slope of a line representing the difference of the first threshold pressure signal and the second threshold pressure signal over time and compares the slope with a threshold decay value, representing a leak in the pump. The control means sends one or more error messages to the operator in response to the slope exceeding the threshold value indicating one or more leaks in the check valve or the pump apparatus in fluid communication with the second pump chamber under pressure.

Preferably, in the test mode, the control means sends a pumping signal to the first motor, and sends a close signal to the switchable valve to cause the fluid in the first chamber to be placed under a pressure. The first pressure measuring device determines at least one minimal pressure and sends a minimal pressure signal to the control means. Preferably, the control means compares the minimal pressure with a minimal acceptable value. The minimal acceptable value represents a value which is related to acceptable pump performance. Failure to attain such minimal acceptable value suggests a defect in the pump or solution failure. Preferably, the first pressure measuring device determines at least one first threshold pressure at a first time and second threshold pressure at a second time. The first pressure measuring device sends a first threshold pressure signal and a second threshold pressure signal to the control means. The control means calculates the slope of a line representing the difference of the first pressure signal and the second pressure signal over time and compares the slope with a threshold decay value, representing a defect in the pump. The control means sending one or more error messages to the operator in response to the slope exceeding the threshold decay value indicating one defects such as one or more leaks in the inlet valve or the pump apparatus in fluid communication with the first pump chamber under pressure.

Preferably, the apparatus further comprises a second pressure measuring device interposed in fluid communication between the first pump chamber and the check valve. In the test mode, the control means sends a pumping signal to the first motor, to cause the fluid in the first chamber to be placed under a pressure. The second pressure measuring device determines a minimal pressure and sends a minimal pressure signal to the control means. Preferably, the control means compares the minimal pressure with a minimal acceptable value. The minimal acceptable value represents a value that is related to acceptable pump performance. Failure to attain such minimal acceptable value suggests a defect in the pump. Preferably, the second pressure measuring device determines at least one first threshold pressure at a first time and a second threshold pressure at a second time. The second pressure measuring device sends a first threshold pressure signal and a second threshold pressure signal to the control means. The control means calculates the slope of a line representing the difference of the first pressure signal and the second pressure signal over time and compares the slope with a threshold decay value, representing a defect in the pump. The control means sends one or more error messages to the operator in response to the slope exceeding the threshold decay value or failure to attain the minimal acceptable value indicating one or more defects in the pump such as leaks in the inlet valve or check valve or the pump apparatus in fluid communication with the first pump chamber under pressure.

Preferably, the control means receives a first set of pressure values from the first pressure measuring device and a second set of pressure values form the second pressure measuring device and compares the values to determine errors in the performance of the pressure measuring devices or leaks in the apparatus.

Embodiments of the present method apply to parallel pumps. In a parallel pump, the apparatus further comprises two pump chambers, two inlet valves and two outlet valves. The pump chambers comprising a first pump chamber and a second pump chamber with the first pump chamber receiving fluid from a fluid supply via a first inlet valve and the second pump chamber receiving fluid from a fluid supply via a second inlet valve. The first pumping chamber discharges fluid via a first outlet check valve and the second pumping chamber discharges fluid via a second outlet check valve. The first outlet check valve and the second outlet check valve are in fluid communication with the switchable valve. Preferably, the apparatus comprises two pressure measuring devices and two motors. The motors comprise a first motor mechanically linked to the first pump chamber and a second motor mechanically linked to the second pump chamber. The two pressure measuring devices comprise a first pressure measuring device and a second pressure measuring device. The first pressure measuring device is interposed in fluid communication between the first pumping chamber and the first check valve and the second pressure measuring device is interposed in fluid communication between the second pumping chamber and the second check valve. The configuration allows the first pump chamber and the second pump chamber to be placed in test mode independent of each other.

In the test mode, the control means directs one of the motors to go into pumping mode which places one of the first or second pump chamber under pressure and such apparatus in fluid communication with the pump chamber under pressure through the opposite check valve. The test mode allows testing of the outlet check valve of the opposite pump chamber. And, in the test mode first one motor of on pump chamber is placed in pump mode and then the opposite motor of the opposite pump chamber is placed in pump mode to allow testing of both outlet check valves.

Preferably, the control means receives a first set of pressure values from the first pressure measuring device and a second set of pressure values from the second pressure measuring device and compares the values to determine errors in the performance of pressure measuring devices, the first or second pump chambers, the first and second inlet valves and the outlet check valve.

Further features and advantages of the present invention will be apparent upon reading the detailed description which follows and viewing the drawings that are described in summary form below.

DETAILED DESCRIPTION

Embodiments of the present invention feature methods and apparatus which facilitate the detection of leaks and poor performance of various components of a pump. One embodiment of the present invention is a pumping apparatus for pumping fluid. However, embodiments of the present invention have applications in all fluid application in which information regarding the integrity of seals and fittings and the like is desirable. Thus, the present detailed description should be construed as an exemplification of the invention and not limiting the invention to the details provided.

Figure 1:
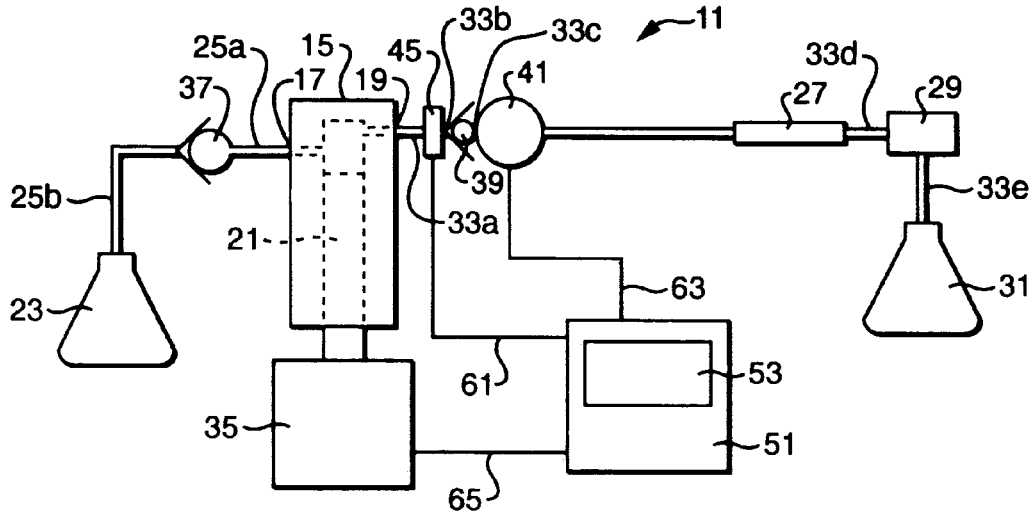
FIG. 1 depicts a single chamber pump apparatus embodying features of the present invention.

Turning now to FIG. 1, a pumping apparatus, generally designated by the numeral 11, is illustrated. Pumping apparatus is of the type normally associated with chromatographic applications. The pumping apparatus 11 has one pumping chamber 15 having an inlet 17 and an outlet 19. The pumping chamber 15 has a piston 21 for movement in the chamber 15. Piston 21 propels the fluid from the chamber. The inlet 17 is for receiving fluid from a fluid supply 23 through conduits 25*a* and 25*b*. The outlet 19 is for discharging the fluid from the chamber to a downstream chromatographic column 27, a detector 29 and a waste receptacle 31 via conduits 33*a*, 33*b*, 33*c*, 33*d* and 33*e*.

A motor 35 powers the piston 21 in the pumping chamber 15 through any number of mechanical devices, such as cams or spindle drives [not shown] known in the art. The motor 35 operates in pumping mode upon receiving a pumping signal.

Inlet valve 37 is in fluid communication with the inlet 17 of the pumping chamber 15 by a suitable conduit 25*a* or by incorporation into the pump head [not shown]. The inlet valve 37 has an open position and a closed position. Preferably, the apparatus 11 further comprises a check valve 39 in fluid communication with the pump chamber 15 downstream of the pump chamber 15. Inlet valve 37 and check valve 39 may be of standard design and features and are available from a number of vendors.

A switchable valve 41 is in fluid communication with the outlet 19 of the pumping chamber 15. The switchable valve 41 has a closed position and an open position. The switchable valve 41 assumes a closed position upon receiving a close signal. Switchable valve 41 may be solenoid controlled or a powered rotating valve. A suitable valve is a multi-position valve sold by Valco Instruments Co. Inc. (Houston, Tex. USA).

A pressure measuring device 45 is in fluid communication with the pumping chamber 15, between the inlet valve 37 and switchable valve 41. The pressure measuring device 45 is, preferably, a pressure transducer which produces a pressure signal in response to pressure. A suitable pressure transducer is a tranducer sold by DJ Instruments (Billerica, Mass. USA).

The apparatus 11 further comprises control means 51 for receiving the pressure signal via line 61, for sending a close signal to the switchable valve 41 via line 63 and for sending a pumping signal to the motor 35 via line 65. The control means 51 is preferably a computer equipped with an operator interface such as monitor or display 53. Suitable computers are available from numerous vendors and include such personal computers having an IBM format or Apple operating system.

The apparatus 11 has a test mode in which the control means 51 sends a pumping signal to the motor 35, sends a close signal to the switchable valve 41 to cause the fluid in the pump chamber 15 to be placed under a pressure. The pressure measuring device 45 determines at least one minimal pressure and sends a minimal pressure signal to the control means 51. Preferably, the control means 51 compares the minimal pressure with a minimal acceptable value. The minimal acceptable value represents a value which is related to acceptable pump performance. Failure to attain such minimal acceptable value suggests a defect in the pump. For a chromatographic pump, such minimal acceptable value may be set at a value from 50 psig to 5000 psig or some other value appropriate for the application for which the pump will be used. A preferred value is between 200 and 500 psig. The time in which the minimal pressure may be determined corresponds to a predetermined stroke position which normal operation will give a value equal or above the minimal acceptable value.

The pressure measuring device 45 determines at least one first threshold pressure at a first time and at least one second pressure at a second time. The first and second time are chosen for a period of time in which the normal pressure decay rate is approximately linear. That is, pressure decay in a normal pump typically is exponential, with the greatest loss of pressure soon after the maximum pressure is attained and falling more steadily thereafter.

The pressure measuring device 45 sends a first threshold pressure signal and sends a second threshold pressure signal to the control means 51. The control means 51 calculates the slope of a line representing the difference of the first pressure signal and the second pressure signal over time and compares the slope with a threshold decay value. The threshold decay value represents a defect in the pump apparatus 11, most likely attributable to a leak. The threshold decay value is preferably determined empirically based upon values and times known to be a characteristic of pump apparatus 11 with acceptable performance. For a parallel pump, used in preparative chromatography applications, a threshold decay value of 100 to 400 psig per minute is preferred. The time between the first and second pressure signal is, preferably, between 0.05 to 3.0 minutes and most preferably, 0.2 to 1.0 minute. In a parallel pump, the period after the maximum pressure is attained and the first threshold pressure is taken is approximately 0.5 to 1.5 minute.

The control means 51 sends one or more error messages to display 53 to the operator in response to the slope exceeding the threshold decay value. In the alternative or in addition, the control means 51 may turn the apparatus off or place it on stand by status until the control means 51 is reset or repairs made on the apparatus 11.

Preferably, the apparatus 11 has a start up mode in which the control means 51 is turned on and the control means 51 engages the test mode to test for leaks. Software controls to effect the comparisons between test values and predetermined values, to provide error messages and/or stop equipment functions are designed to be consistent with the control circuitry and underlying software of the equipment. These software controls, as described herein, are within the skill of competent software engineers.

The apparatus 11, in test mode, preferably performs a dynamic evaluation of the leak. Control means 51 directs motor 35 to pump fluid at constant pressure. In the event motor 35 is a stepper motor or the piston 21 is equipped with a position sensor [not shown], the steps or position are tracked over time and the volume of the leak is determined by the control means 51.

In operation, the operator starts the apparatus by activating an "on" switch or booting the control means 51. At start up, the control means 51 initiates a test mode. The control means 51 sends a pumping signal to the motor 35, sends a close signal to the switchable valve 41 to cause the fluid in the chamber to be placed under a pressure. The pressure measuring device 45 determines a minimal pressure at a first time and sends a minimal pressure signal to the control means 51. Preferably, the control means 51 compares the minimal pressure with a minimal acceptable value. The minimal acceptable value represents a value which is related to acceptable pump performance. Failure to attain such minimal acceptable value suggests a defect in the pump or solution failure.

The pressure measuring device 45 determines at least one first threshold pressure at a first time and a second threshold pressure at a second time. The pressure measuring device sends a first threshold pressure signal and a second threshold pressure signal to the control means 51. The control means 51 calculates the slope of a line representing the difference of the first threshold pressure signal and the second threshold pressure signal over time and compares the slope with a threshold decay value, representing a defect in the apparatus 11 most likely associated with a leak. The control means 51 sends one or more error messages to the operator in response to the slope exceeding the threshold decay value. The defect or leak may further be characterized by control means which directs the motor 35 in a manner of constant pressure by monitoring the pressure via a feed back from the pressure measuring device 45.

Figure 2:
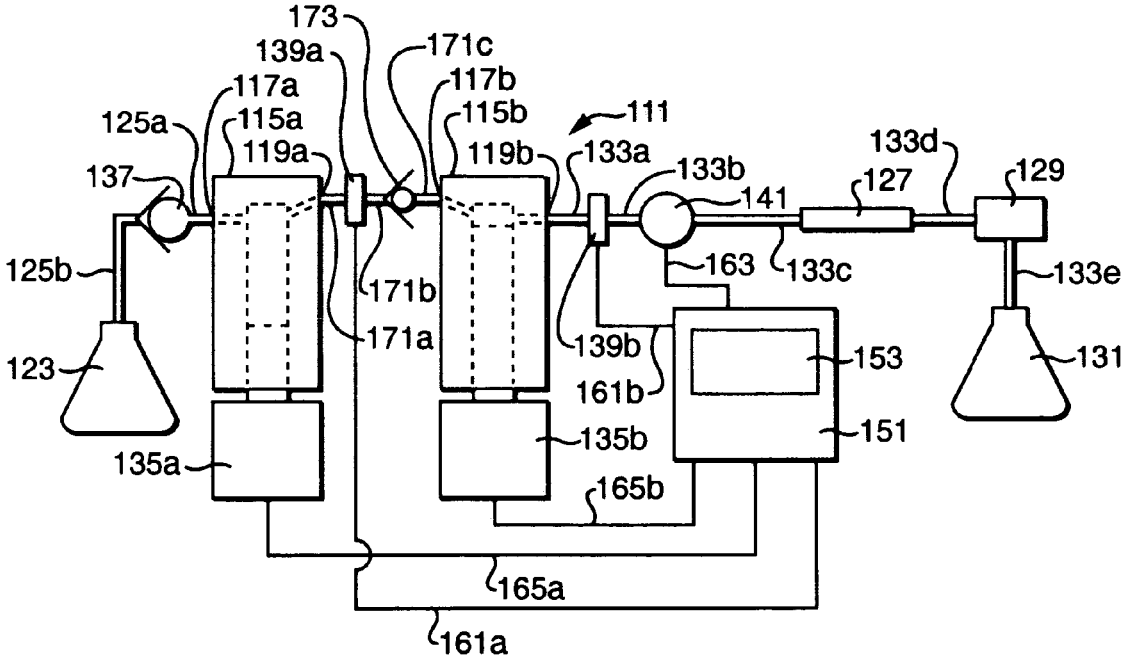
FIG. 2 depicts a dual chamber series pump apparatus embodying features of the present invention.

Embodiments of the apparatus may have more than one pumping chamber. One of the apparatus further comprises two pump chambers, a first pump chamber and a second pump chamber in series. Such a series pump apparatus is generally depicted in FIG. 2, by reference number 111. Serial apparatus 111 has a first pump chamber 115*a* having an inlet 117*a* and outlet 119*a*. First pump chamber 115*a* receives fluid from a fluid supply 123 via conduits 125*a* and 125*b* through an inlet check valve 137. Serial pump 111 has a second pump chamber 115*b* having an inlet 117*b* and outlet 119*b*. First pump chamber 115*a* is in fluid communication with the second pump chamber 115*b* via conduits 171*a*, 171*b* and 171*c*. Check valve 173 is in fluid communication with the first pump chamber 115*a* and the second pump chamber 115*b*.

The second pump chamber 115*b* discharges fluid to the switchable valve 141 via conduits 133*a* and 133*b*. Conduits 133*c*, 133*d* and 133*e* connect switchable valve 141 to chromatography column 127, detector 129 and waste receptacle 131.

A first pressure measuring device 139*a* is in fluid communication with first pump chamber 115*a* interposed between such chamber and check valve 173. A second pressure measuring device 139*b* is in fluid communication with the second pump chamber 115*b* interposed between such chamber and the switchable valve 141.

The apparatus 111 has two motors, a first motor 135*a* mechanically linked to the first pump chamber 115*a* and a second motor 135*b* mechanically linked to the second pump chamber 115*b*.

The apparatus 111 further comprises control means 151 for receiving the pressure signals via lines 161*a* and 161*b*, for sending a close signal to the switchable valve 141 via line 163 and for sending a pumping signal to the motors 135*a* and 135*b* via lines 165*a* and 165*b*. The control means 151 is preferably a computer equipped with a monitor or display 153. And, in the test mode, the control means 151 sends a signal to the first motor 135*a* and second motor 135*b*.

In the test mode, the control means 151 sends a pumping signal to the second motor 135*b*, sends a close signal to the switchable valve 141 to cause the fluid in the second pump chamber 115*b* to be placed under a pressure. The second pressure measuring device 139*b* determines a minimal pressure and sends a minimal pressure signal to the control means. Preferably, the control means 151 compares the minimal pressure with a minimal acceptable value. The minimal acceptable value represents a value which is related to acceptable pump performance. Failure to attain such minimal acceptable value suggests a defect in the pump 111 or solution failure.

Preferably, the second pressure measuring device 139*b* determines at least one first threshold pressure at a first time and at least one second threshold pressure at a second time. The second pressure measuring device 139*b* sends a first threshold pressure signal and a second threshold pressure signal to the control means 151. The control means 151 calculates the slope of a line representing the difference of the first threshold pressure signal and the second threshold pressure signal over time and compares the slope with a threshold decay value, where the threshold decay value represents a defect, most likely associated with a leak, in the pump 111. The control means 151 sends one or more error messages to the operator in response to the slope exceeding the threshold decay value or failure to attain the mininmal acceptable value indicating one or more defects in the pump 111, such as, leaks in the check valve 171*b* or the pump apparatus 111 in fluid communication with the second pump chamber 115*b* under pressure.

In the alternative or in addition, in the test mode, the control means 151 sends a pumping signal to the first motor 135*a*, sends a close signal to the switchable valve 141 to cause the fluid in the first pump chamber 115*a* to be placed under a pressure. The first pressure measuring device 139*a* determines a minimal pressure and sends a first minimal pressure signal to the control means 151. Preferably, the control means 151 compares the minimal pressure with a minimal acceptable value. The minimal acceptable value represents a value which is related to acceptable pump performance. Failure to attain such minimal acceptable value suggests a defect in the pump or solution failure.

The first pressure measuring device 139*a* determines at least one second pressure at a second time and sends a second pressure signal to the control means 151. The control means 151 calculates the slope of a line representing the difference of the first pressure signal and the second pressure signal over time and compares the slope with a threshold decay value. The threshold decay value represents a defect, most likely associated with a leak in the pump 111. The control means 151 sends one or more error messages to the operator in response to the slope exceeding the threshold decay value indicating one or more defects in the pump 111, such as, leaks in the inlet valve 127 or the pump apparatus 111 in fluid communication with the first pump chamber 115*a* under pressure.

Preferably, the control means 151 receives a first set of pressure values from the first pressure measuring device 139*a* and a second set of pressure values form the second pressure measuring device 139*b* and compares the values to determine errors in the performance of the pressure measuring devices or leaks in the apparatus 111.

In operation, in the test mode, the control means 151 sends a pumping signal to the second motor 135*b*, sends a close signal to the switchable valve 141 to cause the fluid in the second chamber 115*b* to be placed under a pressure. The second pressure measuring device 139*b* determines a minimal pressure and sends a first pressure signal to the control means 115. Preferably, the control means 151 compares the minimal pressure with a minimal acceptable value. The minimal acceptable value represents a value which is related to acceptable pump performance. Failure to attain such minimal acceptable value suggests a defect in the pump.

Preferably, the second pressure measuring device 139*b* determines at least one first threshold pressure at a first time and at least one second threshold pressure at a second time. The first pressure measuring device 139*b* sends a first threshold pressure signal and a second threshold pressure signal to the control means 151. The control means 151 calculates the slope of a line representing the difference of the first pressure signal and the second pressure signal over time and compares the slope with a threshold decay value, representing a defect, most likely associated with a leak in the pump 111. The control means 151 sends one or more error messages to the operator in response to the slope exceeding the threshold value or indicating one or more leaks in the check valve 171*b* or the pump apparatus 111 in fluid communication with the second pump chamber 115*b* under pressure.

Preferably, in the test mode, the control means 151 sends a pumping signal to the first motor 135*a*, and sends a close signal to the switchable valve 141 to cause the fluid in the first chamber 115*a* to be placed under a pressure. The first pressure measuring device 139*a* determines a minimal pressure and sends a minimal pressure signal to the control means 151. Preferably, the control means 151 compares the first pressure with a minimal acceptable value. The minimal acceptable value represents a value which is related to acceptable pump performance. Failure to attain such minimal acceptable value suggests a defect in the pump or solution failure.

Preferably, the first pressure measuring device 139*a* determines at least one first threshold pressure at a first time and at least one second threshold pressure at a second time. The first pressure measuring device 139*a* sends a first threshold pressure signal and a second threshold pressure signal to the control means 151. The control means 151 calculates the slope of a line representing the difference of the first pressure signal and the second pressure signal over time and compares the slope with a threshold decay value, representing a defect, most likely associated with a leak in the pump. The control means 151 sends one or more error messages to the operator in response to the slope exceeding the threshold value or a failure to attain the minimal acceptable value, indicating one or more defect in the pump 111, such as, leaks in the inlet valve 127 or the pump apparatus 111 in fluid communication with the first pump chamber 115*a* under pressure.

Preferably, the control means 151 receives a first set of pressure values from the first pressure measuring device 139*a* and a second set of pressure values form the second pressure measuring device 139*b* and compares the values to determine errors in the performance of the pressure measuring devices 139*a* and 139*b* or leaks in the apparatus 111.

Figure 3:
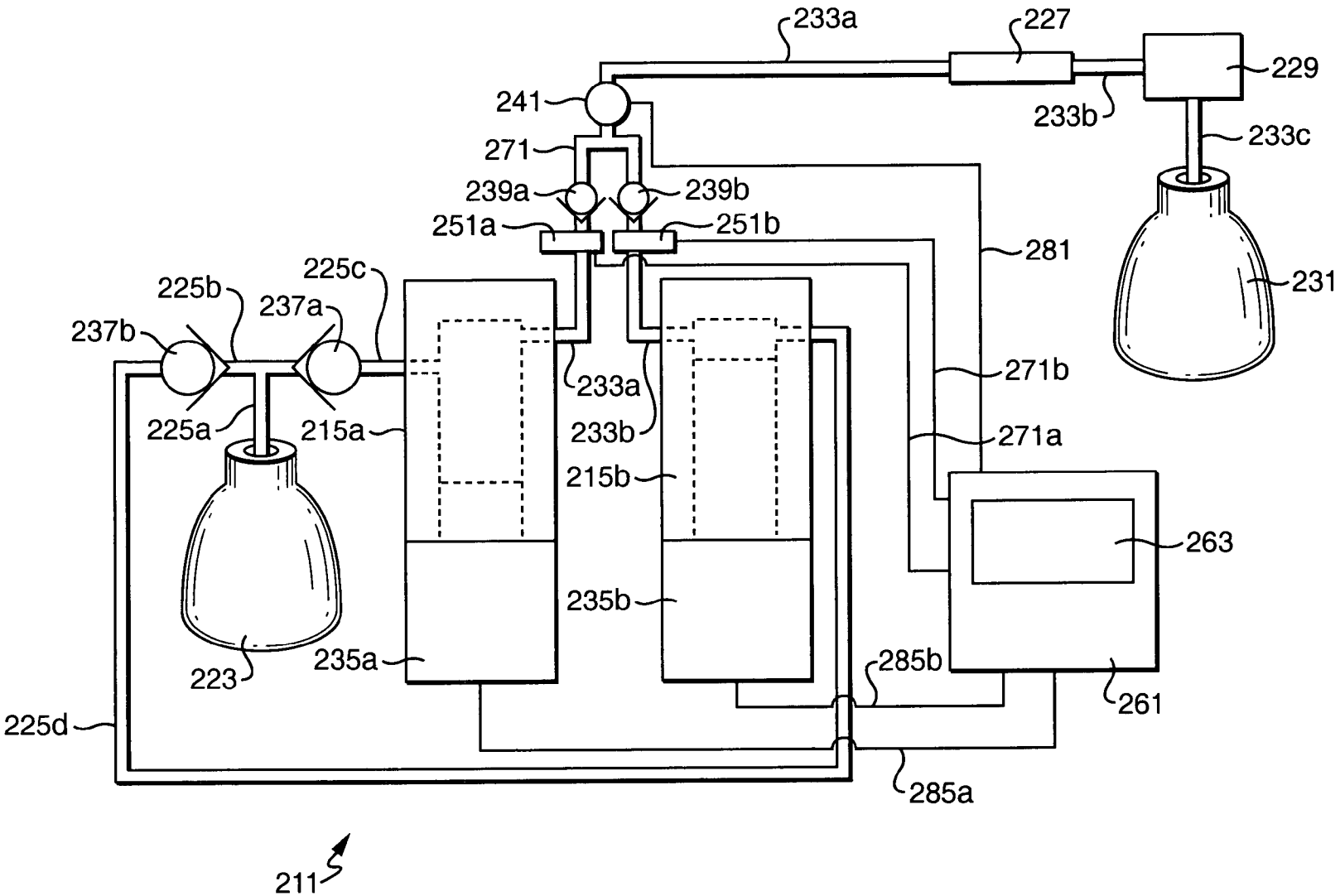
FIG. 3 depicts a dual chamber parallel pump apparatus embodying features of the present invention; and, FIG. 4 graphically depicts a pressure plot from a pressure measuring device over time and threshold value.

Embodiments of the present invention are useful in pumps in a parallel configuration. FIG. 3 depicts a pumping apparatus, generally designated by the numeral 211, of the parallel type. The pumping apparatus 211 has two pump chambers in parallel, a first pump chamber 215*a* and a second pump chamber 215*b*. The first pump chamber 215*a* receives fluid from a fluid supply 223 via a first inlet valve 237*a* and conduits 225*a*, 225*b* and 225*c*. The second pump chamber 215*b* receives fluid from fluid supply 223 via a second inlet valve 237*b* via conduits 225*a*, 225*b* and 225*d*. The first pumping chamber 215*a* discharges fluid via a first outlet check valve 239*a* and via conduit 233*a*. The second pumping chamber 215*b* discharges fluid via a second outlet check valve 239*b* via conduit 233*b*. The first outlet check valve 239*a* and the second outlet check valve 239*b* are in fluid communication with the switchable valve 241 via conduits 271 which form a "T". From the switchable valve, fluid flows to a chromatographic column 227, detector 229 and a waste receptacle 231 through conduits 233*a*, 233*b* and 233*c*.

As depicted, the apparatus 211 further comprises two pressure measuring devices 251*a* and 251*b* and two motors 235*a* and 235*b*. The motors comprise a first motor 235*a* mechanically linked to the first pump chamber 215*a* and a second motor 235*b* mechanically linked to the second pump chamber 215*b*. The two pressure measuring devices comprise a first pressure measuring device 251*a* and a second pressure measuring device 251*b*. The first pressure measuring device 251*a* is interposed in fluid communication between the first pumping chamber 215*a* and the first check valve 239*a*. The second pressure measuring device 251*b* is interposed in fluid communication between the second pumping chamber 215*b* and the second check valve 239*b*. The two pressure measuring devices 251*a* and 251*b* allow the first pump chamber 215*a* and the second pump chamber 215*b* to be placed in test mode independent of each other.

The apparatus 211 further comprises control means 261 for receiving the pressure signals via lines 271*a* and 271*b*, for sending a close signal to the switchable valve 241 via line 281 and for sending a pumping signal to the motors 235*a* and 235*b* via lines 285*a* and 285*b*. The control means 261 is preferably a computer equipped with a monitor or display 263.

In the test mode, the control means 261 directs one of the motors 235*a* or 235*b* to go into pumping mode which places one of the first or second pump chamber 215*a* or 215*b* under pressure and such apparatus in fluid communication with the pump chamber under pressure through to the opposite check valve 239*a* or 239*b*. In this manner, the outlet check valve of the opposite pump chamber can be tested in a parallel pump. And, of course, in the test mode, first one motor of one pump chamber is placed in pump mode and then the opposite motor of the opposite pump chamber is placed in pump mode to allow testing of both outlet check valves 239*a* or 239*b*.

Preferably, the control means receives a first set of pressure values from the first pressure measuring device 251*a* and a second set of pressure values from the second pressure measuring device 251*b* and compares the values. Differences in the values suggest errors in the performance of the pressure measuring devices, the first or second pump chambers 215*a* or 215*b*, the first and second inlet valves 237*a* or 237*b* or the outlet check valves 239*a* or 239*b*. These values can also be compared to predetermined minimal acceptable values. Where the test values comprise a first pressure and a second pressure reading separated by time, the test values are compared to threshold decay values as described previously.

In operation, in the test mode, the control means 261 directs one of the motors 235*a* or 235*b* to go into pumping mode which places one of the first or second pump chamber 215*a* or 215*b* under pressure and such apparatus in fluid communication with the pump chamber under pressure through the opposite check valve 239*a* or 239*b*. The test mode allows testing of the outlet check valve of the opposite pump chamber. And, in the test mode first one motor of one pump chamber is placed in pump mode and then the opposite motor of the opposite pump chamber is placed in pump mode to allow testing of both outlet check valves.

Figure 4:
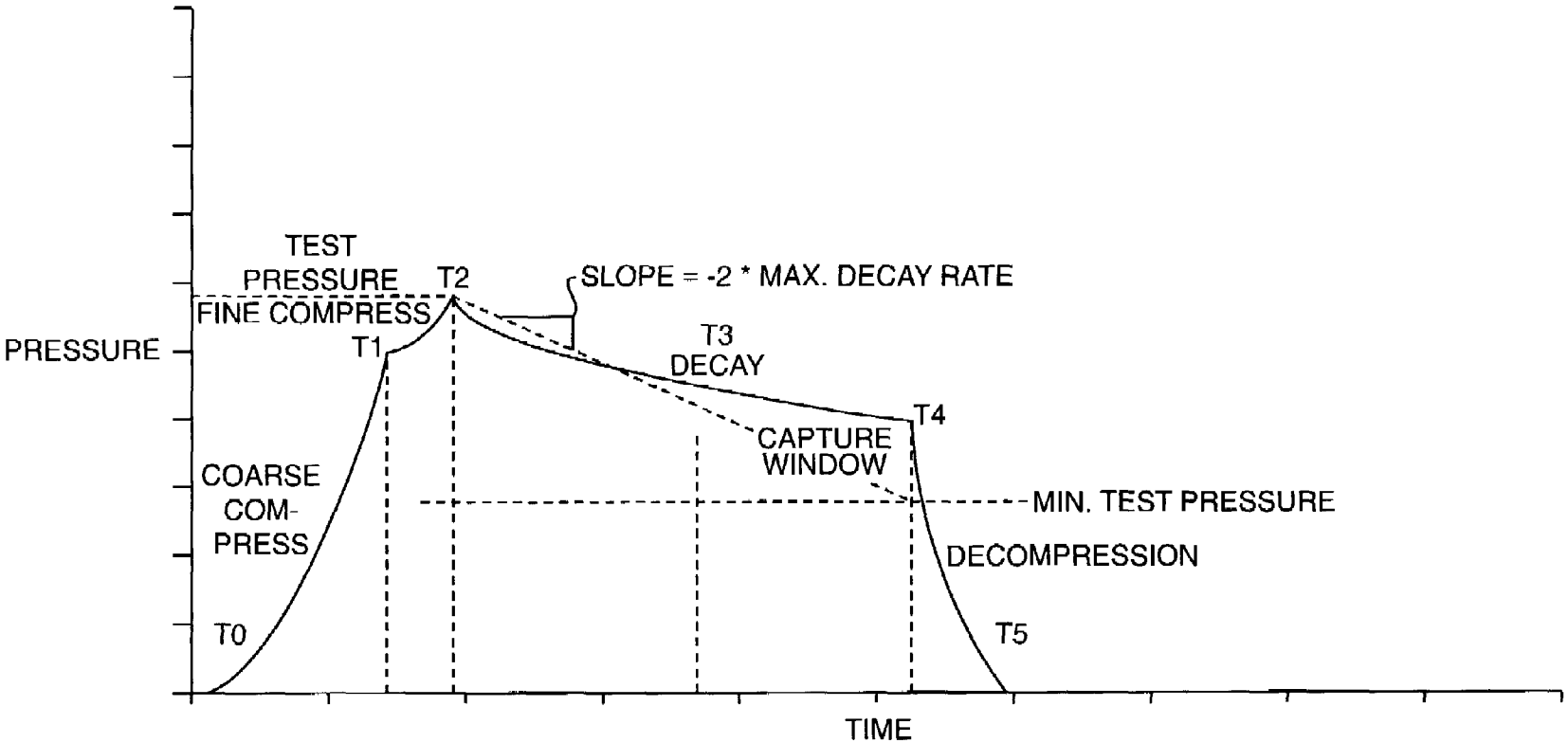

Turning now to FIG. 4, such figure depicts the functional behavior of a test mode of one half of the hydraulic circuit of a parallel pump, measuring pressure over time. During the period $T_0$ to $T_1$ the control means 261 switches switchable valve 141 to close, directs one of the motors 235*a* or 235*b* to go into pumping mode which places one of the first or second pump chamber 215*a* or 215*b* under pressure and such apparatus in fluid communication with the pump chamber under pressure through to the opposite check valve 239*a* or 239*b*.

The period $T_0$ to $T_1$ is a period of course compression. The purpose of the course compression is to quickly bring the hydraulic circuit to approximately the pressure at which the pump will operate or the minimal acceptable pressure. Following the period of course compression, the control means 261 directs the motor to go into a pumping mode that is more tightly controlled. This period between $T_1$ and $T_2$, a period of fine compression is intended to bring the system to at least a minimal acceptable pressure. A pressure value from the first pressure measuring device 251*a* or from the second pressure measuring device 251*b* is obtained at or about $T_2$. Control means 261 compares the value to a minimal acceptable value. Failure to attain this value during the period $T_1$ and $T_2$ suggests a defect in the pump 111.

During the period $T_2$ to $T_4$ the control means 261 directs the motors 235*a* or 235*b* to remain static. Typically, this period is approximately 0.1 to 5 minutes, and, most preferably, 0.2 to 1.0 minutes. At $T_3$ a further threshold pressure value is obtained from the first pressure measuring device 251*a* or from the second pressure measuring device 251*b*. And, at $T_4$ a further threshold pressure value is obtained. Control means 261 calculates the slope of a line between the pressure values taken at $T_3$ and $T_4$. If the pressure values are taken continuous over such period, the values assume a curve sloping downward, representing a typical decay of pressure over time. In the event a leak was present, the curve would assume a more distinct downward slope. The value at $T_3$ and $T_4$ would be substantially lower than depicted. The slope of the calculated line is compared to the threshold decay value represented by the dotted line extending between $T_2$ and $T_4$. This slope is illustrated for discussion purposes with the actual value being determined empirically. If the slope of the calculated line greater than the threshold value, control means 261 sends an error message.

Having completed the test, if acceptable values are achieved the pump 111 can assume normal pumping operation. To enter pumping mode, during the period $T_3$ to $T_4$, the control means 261 depressurizes the hydraulic circuit by backing off the pistons or by switching the switchable valve 141 to open.

The profile depicted in FIG. 4 corresponds to a pump having a pump chamber with a 1200 microliter capacity. As depicted in FIG. 4, the pressure attained during the course compression period is 250.0 psig. The normal flow rate for the pump, if valves were open, which they are not would be 3.0 ml per minute. The period of in time which the decay rate slope is calculated is 0.5 minute. The decay rate limit is 300 psig per minute.

Thus, features of the present invention have been described with the understanding that the description is an exemplification of the invention and the invention should not be so limited. The invention is described more fully in the claims which follow.

What is claimed is:

1. A pumping apparatus for pumping fluid comprising:

at least one pumping chamber having an inlet and an outlet, said pumping chamber having a piston for movement in said chamber which piston propels said fluid from said chamber, said inlet for receiving fluid from a fluid supply and said outlet for discharging said fluid from said chamber;

at least one motor for powering said piston in said pumping chamber, said motor operating in a pumping mode upon receiving a pumping signal;

at least one inlet valve in fluid communication with said inlet of said pumping chamber, said inlet valve having an open position and a closed position;

at least one switchable valve in fluid communication with said outlet of said pumping chamber, said at least one switchable valve having a closed position and an open position, and said at least one switchable valve assuming said closed position upon receiving a close signal;

at least one first pressure measuring device in fluid communication with said pumping chamber, between said inlet valve and switchable valve, said at least one pressure measuring device producing a pressure signal in response to pressure;

control means for receiving said pressure signal, for sending a close signal to said at least one switchable valve and for sending a pumping signal to said motor, said control means having a test mode in which said control means send a pumping signal to said motor, sends a close signal to said switchable valve to cause said fluid in said chamber to be placed under a pressure, said first pressure measuring device determining a first threshold pressure at a first time and sending a first threshold pressure signal to said control means, said first pressure measuring device determining at least one second threshold pressure at a second time and sending a second threshold pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value.

2. The apparatus of claim 1 further comprising a check valve interposed in fluid communication between said at least one pump chamber and said switchable valve.

3. The apparatus of claim 1 wherein said apparatus has a start up mode in which said control means is turned on and said control means engages said test mode upon start up to test for leaks.

4. The apparatus of claim 1 further comprising two pump chambers said pump chambers comprising a first pump chamber and a second pump chamber said first pump chamber and second pump chamber in series with said first pump chamber receiving fluid from a fluid supply and in fluid communication with said second chamber to discharge said fluid to said second chamber, and at least one check valve interposed in fluid communication with said first pump chamber and said second pump chamber.

5. The apparatus of claim 4 further comprising two motors, a first motor mechanically linked to said first pump chamber and a second motor mechanically linked to said second pump chamber, wherein in said test mode said control means sends a signal to said first motor and second motor.

6. The apparatus of claim 5 wherein in said test mode said control means sends a pumping signal to said second motor, sends a close signal to said switchable valve to cause said fluid in said second chamber to be placed under a pressure, said first pressure measuring device determining a first threshold pressure at a first time and sending a first threshold pressure signal to said control means, said first pressure measuring device determining at least one second threshold pressure at a second time and sending a second threshold pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value indicating one or more leaks in said check valve or said pump apparatus in fluid communication with the second pump chamber under pressure.

7. The apparatus of claim 5 wherein in said test mode said control means sends a pumping signal to said first motor, sends a close signal to said switchable valve to cause said fluid in said first chamber to be placed under a pressure, said first pressure measuring device determining a first threshold pressure at a first time and sending a first pressure signal to said control means, said first pressure measuring device determining at least one second threshold pressure at a second time and sending a second threshold pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value indicating one or more leaks in said inlet valve or said pump apparatus in fluid communication with the first pump chamber under pressure.

8. The apparatus of claim 4 further comprising a second pressure measuring device interposed in fluid communication between said first pump chamber and said check valve, wherein in said test mode said control means sends a pumping signal to said first motor, to cause said fluid in said first chamber to be placed under a pressure, said second pressure measuring device determining a first threshold pressure at a first time and sending a first threshold pressure signal to said control means, said second pressure measuring device determining at least one second threshold pressure at a second time and sending a second threshold pressure signal to said control means, said control means calculating the slope of a line representing the difference of said first pressure signal and said second pressure signal over time and comparing said slope with a threshold value, said threshold value representing a leak in the pump, said control means sending one or more error messages to the operator in response to said slope exceeding said threshold value indicating one or more leaks in said inlet valve or check valve or said pump apparatus in fluid communication with the first pump chamber under pressure.

9. The apparatus of claim 8 wherein said control means sends a close signal to said switchable valve, and said control means receives a first set of pressure values from said first pressure measuring device and a second set of pressure values from said second pressure measuring device and compares said values to determine errors in the performance of said pressure measuring devices or leaks in the apparatus.

10. The apparatus of claim 1 further comprising two pump chambers, two inlet valves and two outlet valves, said pump chambers comprising a first pump chamber and a second pump chamber, said two inlet valves comprising a first inlet valve and a second inlet valve and said two outlet valves comprising a first outlet check valve and a second outlet check valve said first pump chamber and second pump chamber in parallel with said first pump chamber receiving fluid from a fluid supply via said first inlet valve and said second pump chamber receiving fluid from a fluid supply via said second inlet valve, said first pumping chamber discharging said fluid via said first outlet check valve and said second pumping chamber discharging said fluid via said second outlet check valve, said first outlet check valve and said second outlet check valve in fluid communication with said switchable valve.

11. The apparatus of claim 10 further comprising two pressure measuring devices and two motors, said motors comprising a first motor mechanically linked to said first pump chamber and a second motor mechanically linked to said second pump chamber, said two pressure measuring devices comprising a first pressure measuring device and a second pressure measuring device, said first pressure measuring device interposed in fluid communication between said first pumping chamber and said first check valve and said second pressure measuring device interposed in fluid communication between said second pumping chamber and said second check valve, to allow said first pump chamber and said second pump chamber to be placed in test mode independent of each other.

12. The apparatus of claim 11 wherein in said test mode said control means directs one of said motors to go into pumping mode which places one of said first or second pump chamber under pressure and such apparatus in fluid communication with said pump chamber under pressure through said opposite check valve, to allow testing of the outlet check valve of the opposite pump chamber.

13. The apparatus of claim 12 wherein in said test mode first one motor of one pump chamber is placed in pump mode and then the opposite motor of the opposite pump chamber is placed in pump mode to allow testing of the two outlet check valves.

14. The apparatus of claim 11 wherein said control means sends a close signal to said switchable valve, and said control means receives a first set of pressure values from said first pressure measuring device and a second set of pressure values from said second pressure measuring device and compares said values to determine errors in the performance of at least one of the following components selected from the group consisting of said pressure measuring devices, said first or second pump chambers, said first and second inlet valves and said outlet check valve.

15. A method of testing the performance of a pumping apparatus for pumping fluid comprising the steps of:

(i) providing a pumping apparatus comprising at least one pumping chamber having an inlet and an outlet, said pumping chamber having a piston for movement in said chamber which piston propels said fluid from said chamber, said inlet for receiving fluid from a fluid supply and said outlet for discharging said fluid from said chamber;

at least one motor for powering said piston in said pumping chamber, said motor operating in a pumping mode upon receiving a pumping signal;

at least one inlet valve in fluid communication with said inlet of said pumping chamber, said inlet valve having an open position and a closed position;

at least one switchable valve in fluid communication with said outlet of said pumping chamber, said at least one switchable valve having a closed position and an open position, and said at least one switchable valve assuming said closed position upon receiving a close signal;

at least one first pressure measuring device in fluid communication with said pumping chamber, between said inlet valve and switchable valve, said at least one pressure measuring device producing a pressure signal in response to pressure;

control means for receiving said pressure signal, for sending a close signal to said at least one switchable valve and for sending a pumping signal to said motor, said control means having a test mode in which said control means send a pumping signal to said motor, sends a close signal to said switchable valve to cause said fluid in said chamber to be placed under a pressure, said first pressure measuring device determining a first threshold pressure at a first time and sending a first threshold pressure signal to said control means, said first pressure measuring device determining at least one second threshold pressure at a second time and sending a second threshold pressure signal to said control means, said control means calculating the slope of a line representing the difference of said first pressure signal and said second pressure signal over time and comparing said slope with a threshold value, said threshold value representing a leak in the pump, said control means sending one or more error messages to the operator in response to said slope exceeding said threshold value; and, (ii) operating said apparatus in test mode.

16. The method of claim 15 wherein said apparatus further comprises a check valve interposed in fluid communication between said at least one pump chamber and said switchable valve.

17. The method of claim 15 wherein said apparatus has a start up mode in which said control means is turned on and said control means engages said test mode upon start up to test for leaks.

18. The method of claim 15 wherein said apparatus further comprises two pump chambers said pump chambers comprising a first pump chamber and a second pump chamber said first pump chamber and second pump chamber in series with said first pump chamber receiving fluid from a fluid supply and in fluid communication with said second chamber to discharge said fluid to said second chamber, and at least one check valve interposed in fluid communication with said first pump chamber and said second pump chamber.

19. The method of claim 15 wherein said apparatus further comprising two motors, a first motor mechanically linked to said first pump chamber and a second motor mechanically linked to said second pump chamber, wherein in said test mode said control means sends a signal to said first motor and second motor.

20. The method of claim 19 wherein in said test mode said control means sends a pumping signal to said second motor, sends a close signal to said switchable valve to cause said fluid in said second chamber to be placed under a pressure, said first pressure measuring device determining a first threshold pressure at a first time and sending a first threshold pressure signal to said control means, said first pressure measuring device determining at least one second threshold pressure at a second time and sending a second threshold pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value indicating one or more leaks in said check valve or said pump apparatus in fluid communication with the second pump chamber under pressure.

21. The apparatus of claim 19 wherein in said test mode said control means sends a pumping signal to said first motor, sends a close signal to said switchable valve to cause said fluid in said first chamber to be placed under a pressure, said first pressure measuring device determining a first threshold pressure at a first time and sending a first threshold pressure signal to said control means, said first pressure measuring device determining at least one second threshold pressure at a second time and sending a second pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value indicating one or more leaks in said inlet valve or said pump apparatus in fluid communication with the first pump chamber under pressure.

22. The method of claim 18 further wherein said apparatus further comprises a second pressure measuring device interposed in fluid communication between said first pump chamber and said check valve, wherein in said test mode said control means sends a pumping signal to said first motor, to cause said fluid in said first chamber to be placed under a pressure, said second pressure measuring device determining a first threshold pressure at a first time and sending a first threshold pressure signal to said control means, said second pressure measuring device determining at least one second threshold pressure at a second time and sending a second threshold pressure signal to said control means, said control means calculating the slope of a line representing the difference of said first threshold pressure signal and said second threshold pressure signal over time and comparing said slope with a threshold value, said threshold value representing a leak in the pump, said control means sending one or more error messages to the operator in response to said slope exceeding said threshold value indicating one or more leaks in said inlet valve or check valve or said pump apparatus in fluid communication with the first pump chamber under pressure.

23. The method of claim 22 wherein said control means sends a close signal to said switchable valve, and said control means receives a first set of pressure values from said first pressure measuring device and a second set of pressure values from said second pressure measuring device and compares said values to determine errors in the performance of said pressure measuring devices or leaks in the apparatus.

24. The method of claim 15 wherein said apparatus further comprises two pump chambers, two inlet valves and two outlet valves, said pump chambers comprising a first pump chamber and a second pump chamber said first pump chamber and second pump chamber in parallel with said first pump chamber receiving fluid from a fluid supply via a first inlet valve and said second pump chamber receiving fluid from a fluid supply via a second inlet valve, said first pumping chamber discharging said fluid via a first outlet check valve and said second pumping chamber discharging said fluid via a second outlet check valve, said first outlet check valve and said second outlet check valve in fluid communication with said switchable valve.

25. The method of claim 24 wherein said apparatus further comprising two pressure measuring devices and two motors, said motors comprising a first motor mechanically linked to said first pump chamber and a second motor mechanically linked to said second pump chamber, said two pressure measuring devices comprising a first pressure measuring device and a second pressure measuring device, said first pressure measuring device interposed in fluid communication between said first pumping chamber and said first check valve and said second pressure measuring device interposed in fluid communication between said second pumping chamber and said second check valve, to allow said first pump chamber and said second pump chamber to be placed in test mode independent of each other.

26. The method of claim 25 wherein in said test mode said control means directs one of said motors to go into pumping mode which places one of said first or second pump chamber under pressure and such apparatus in fluid communication with said pump chamber under pressure through said opposite check valve, to allow testing of the outlet check valve of the opposite pump chamber.

27. The method of claim 26 wherein in said test mode first one motor of one pump chamber is placed in pump mode and then the opposite motor of the opposite pump chamber is placed in pump mode to allow testing of the two outlet check valves.

28. The method of claim 27 wherein said control means sends a close signal to said outlet valve, and said control means receives a first set of pressure values from said first pressure measuring device and a second set of pressure values from said second pressure measuring device and compares said values to determine errors in the performance of at least one of the following components selected from the group consisting of said pressure measuring devices, said first or second pump chambers, said first and second inlet valves and said outlet check valve.

29. A pumping apparatus for pumping fluid comprising:

at least one pumping chamber having an inlet and an outlet, said pumping chamber having a piston for movement in said chamber which piston propels said fluid from said chamber, said inlet for receiving fluid from a fluid supply and said outlet for discharging said fluid from said chamber at least one motor for powering said piston in said pumping chamber, said motor operating in pumping mode upon receiving a pumping signal;

at least one inlet valve in fluid communication with said inlet of said pumping chamber, said inlet valve having an open position and a closed position;

at least one switchable valve in fluid communication with said outlet of said pumping chamber, said at least one switchable valve having a closed position and an open position, and said at least one switchable valve assuming said closed position upon receiving a close signal;

at least one first pressure measuring device in fluid communication with said pumping chamber, between said inlet valve and switchable valve, said at least one pressure measuring device producing a pressure signal in response to pressure;

control means for receiving said pressure signal, for sending a close signal to said at least one switchable valve and for sending a pumping signal to said motor, said control means having a test mode in which said control means send a pumping signal to said motor, sends a close signal to said switchable valve to cause said fluid in said chamber to be placed under a pressure, said first pressure measuring device determining a minimal pressure and sending a minimal pressure signal to said control means, said control means comparing said first pressure signal to minimal acceptable value, said minimal acceptable value representing a defect in the pump, said control means sending one or more error messages to the operator in response to said first pressure signal failing to attain said minimal acceptable value.

30. The apparatus of claim 29 further comprising a check valve interposed in fluid communication between said at least one pump chamber and said switchable valve.

31. The apparatus of claim 29 wherein said apparatus has a start up mode in which said control means in turned on and said control means engages said test mode upon start up to test for defects.

32. The apparatus of claim 29 further comprising two pump chambers said pump chambers comprising a first pump chamber and a second pump chamber said first pump chamber and second pump chamber in series with said first pump chamber receiving fluid from a fluid supply and in fluid communication with said second chamber to discharge said fluid to said second chamber, and at least one check valve interposed in fluid communication with said first pump chamber and said second pump chamber.

33. The apparatus of claim 32 further comprising two motors, a first motor mechanically linked to said first pump chamber and a second motor mechanically linked to said second pump chamber, wherein in said test mode said control means sends a signal to said first motor and second motor.

34. The apparatus of claim 33 wherein in said test mode said control means sends a pumping signal to said second motor, sends a close signal to said switchable valve to cause said fluid in said second chamber to be placed under a pressure, said first pressure measuring device determining a minimal pressure and sending a minimal pressure signal to said control means, said control means comparing said minimal pressure signal to a minimal acceptable value, said minimal acceptable value representing a defect in the pump, said control means sending one or more error messages to the operator in response to said first pressure signal failing to attain said minimal acceptable value.

35. The apparatus of claim 33 wherein in said test mode said control means sends a pumping signal to said first motor, sends a close signal to said switchable valve to cause said fluid in said first chamber to be placed under a pressure, said first pressure measuring device determining a minimal pressure and sending a minimal pressure signal to said control means, said control means comparing said minimal pressure signal to minimal acceptable value, said minimal acceptable value representing a defect in the pump, said control means sending one or more error messages to the operator in response to said first pressure signal failing to attain said minimal acceptable value.

36. The apparatus of claim 32 further comprising a second pressure measuring device interposed in fluid communication between said first pump chamber and said check valve, wherein in said test mode said control means sends a pumping signal to said first motor, to cause said fluid in said first chamber to be placed under a pressure, said second pressure measuring device determining a minimal pressure and sending a minimal pressure signal to said control means, said control means comparing said minimal pressure signal to minimal acceptable value, said minimal acceptable value representing a defect in the pump, said control means sending one or more error messages to the operator in response to said first pressure signal failing to attain said minimal acceptable value.

37. The apparatus of claim 36 wherein said control means sends a close signal to said switchable valve, and said control means receives a first set of pressure values from said first pressure measuring device and a second set of pressure values form said second pressure measuring device and compares said values to determine defects in the apparatus.

38. The apparatus of claim 29 further comprising two pump chambers, two inlet valves and two outlet valves, said pump chambers comprising a first pump chamber and a second pump chamber, said two inlet valves comprising a first inlet valve and a second inlet valve and said two outlet valves comprising a first outlet check valve and a second outlet check valve, said first pump chamber and second pump chamber in parallel with said first pump chamber receiving fluid from a fluid supply via said first inlet valve and said second pump chamber receiving fluid from a fluid supply via said second inlet valve, said first pumping chamber discharging said fluid via said first outlet check valve and said second pumping chamber discharging said fluid via said second outlet check valve, said first outlet check valve and said second outlet check valve in fluid communication with said switchable valve.

39. The apparatus of claim 38 further comprising two pressure measuring devices and two motors, said motors comprising a first motor mechanically linked to said first pump chamber and a second motor mechanically linked to said second pump chamber, said two pressure measuring devices comprising a first pressure measuring device and a second pressure measuring device, said first pressure measuring device interposed in fluid communication between said first pumping chamber and said first check valve and said second pressure measuring device interposed in fluid communication between said second pumping chamber and said second check valve, to allow said first pump chamber and said second pump chamber to be placed in test mode independent of each other.

40. The apparatus of claim 39 wherein in said test mode said control means directs one of said motors to go into pumping mode which places one of said first or second pump chamber under pressure and such apparatus in fluid communication with said pump chamber under pressure through said opposite check valve, to allow testing of the outlet check valve of the opposite pump chamber.

41. The apparatus of claim 40 wherein in said test mode first one motor of on pump chamber is placed in pump mode and then the opposite motor of the opposite pump chamber is placed in pump mode to allow testing of the two outlet check valves.

42. The apparatus of claim 40 wherein said control means sends a close signal to said switchable valve, and said control means receives a first set of pressure values from said first pressure measuring device and a second set of pressure values from said second pressure measuring device and compares said values to determine defects in the apparatus.

43. A method of testing the performance of a pumping apparatus for pumping fluid comprising the steps of:

(i) providing a pumping apparatus comprising at least one pumping chamber having an inlet and an outlet, said pumping chamber having a piston for movement in said chamber which piston propels said fluid from said chamber, said inlet for receiving fluid from a fluid supply and said outlet for discharging said fluid from said chamber;

at least one motor for powering said piston in said pumping chamber, said motor operating in a pumping mode upon receiving a pumping signal;

at least one inlet valve in fluid communication with said inlet of said pumping chamber, said inlet valve having an open position and a closed position;

at least one switchable valve in fluid communication with said outlet of said pumping chamber, said at least one switchable valve having a closed position and an open position, and said at least one switchable valve assuming said closed position upon receiving a close signal;

at least one first pressure measuring device in fluid communication with said pumping chamber, between said inlet valve and switchable valve, said at least one pressure measuring device producing a pressure signal in response to pressure;

control means for receiving said pressure signal, for sending a close signal to said at least one switchable valve and for sending a pumping signal to said motor, said control means having a test mode in which said control means send a pumping signal to said motor, sends a close signal to said switchable valve to cause said fluid in said chamber to be placed under a pressure, said first pressure measuring device determining a minimal pressure and sending a minimal pressure signal to said control means, said control means comparing said minimal pressure signal to a minimal acceptable value, said minimal acceptable value representing a defect in the pump, said control means sending one or more error messages to the operator in response to said first pressure signal failing to attain said minimal acceptable value; and, (ii) operating said apparatus in test mode.

44. The method of claim 43 wherein said apparatus further comprises a check valve interposed in fluid communication between said at least one pump chamber and said switchable valve.

45. The method of claim 43 wherein said apparatus has a start up mode in which said control means in turned on and said control means engages said test mode upon start up to test for defects.

46. The method of claim 43 wherein said apparatus further comprises two pump chambers said pump chambers comprising a first pump chamber and a second pump chamber said first pump chamber and second pump chamber in series with said first pump chamber receiving fluid from a discharge said fluid to said second chamber, and at least one check valve second pump chamber.

47. The method of claim 43 wherein said apparatus further comprising two motors, a first motor mechanically linked to said first pump chamber and a second motor mechanically linked to said second pump chamber, wherein in said test mode said control means sends a signal to said first motor and second motor.

48. The method of claim 47 wherein in said test mode said control means sends a pumping signal to said second motor, sends a close signal to said switchable valve to cause said fluid in said second chamber to be placed under a pressure, said first pressure measuring device determining a minimal pressure and sending a minimal pressure signal to said control means, said control means comparing said minimal pressure signal to minimal acceptable value, said minimal acceptable value representing a defect in the pump, said control means sending one or more error messages to the operator in response to said first pressure signal failing to attain said minimal acceptable value.

49. The apparatus of claim 47 wherein in said test mode said control means sends a pumping signal to said first motor, sends a close signal to said switchable valve to cause said fluid in said first chamber to be placed under a pressure, said first pressure measuring device determining a minimal pressure at a first time and sending a minimal pressure signal to said control means, said control means comparing said minimal pressure signal to minimal acceptable value, said minimal acceptable value representing a defect in the pump, said control means sending one or more error messages to the operator in response to said first pressure signal failing to attain said minimal acceptable value.

50. The method of claim 46 further wherein said apparatus further comprises a second pressure measuring device interposed in fluid communication between said first pump chamber and said check valve, wherein in said test mode said control means sends a pumping signal to said first motor, to cause said fluid in said first chamber to be placed under a pressure, said second pressure measuring device determining a minimal pressure and sending a minimal pressure signal to said control means, said control means comparing said first pressure signal to minimal acceptable value, said minimal acceptable value representing a defect in the pump, said control means sending one or more error messages to the operator in response to said first pressure signal failing to attain said minimal acceptable value.

51. The method of claim 50 wherein said control means sends a close signal to said switchable valve, and said control means receives a first set of pressure values from said first pressure measuring device and a second set of pressure values form said second pressure measuring device and compares said values to determine defects in the apparatus.

52. The method of claim 43 wherein said apparatus further comprises two pump chambers, two inlet valves and two outlet valves, said pump chambers comprising a first pump chamber and a second pump chamber said first pump chamber and second pump chamber in parallel with said first pump chamber receiving fluid from a fluid supply via a first inlet valve and said second pump chamber receiving fluid from a fluid supply via a second inlet valve, said first pumping chamber discharging said fluid via a first outlet check valve and said second pumping chamber discharging said fluid via a second outlet check valve, said first outlet check valve and said second outlet check valve in fluid communication with said switchable valve.

53. The method of claim 52 wherein said apparatus further comprising two pressure measuring devices and two motors, said motors comprising a first motor mechanically linked to said first pump chamber and a second motor mechanically linked to said second pump chamber, said two pressure measuring devices comprising a first pressure measuring device and a second pressure measuring device, said first pressure measuring device interposed in fluid communication between said first pumping chamber and said first check valve and said second pressure measuring device interposed in fluid communication between said second pumping chamber and said second check valve, to allow said first pump chamber and said second pump chamber to be placed in test mode independent of each other.

54. The method of claim 53 wherein in said test mode said control means directs one of said motors to go into pumping mode which places one of said first or second pump chamber under pressure and such apparatus in fluid communication with said pump chamber under pressure through said opposite check valve, to allow testing of the outlet check valve of the opposite pump chamber.

55. The method of claim 54 wherein in said test mode first one motor of on pump chamber is placed in pump mode and then the opposite motor of the opposite pump chamber is placed in pump mode to allow testing of the two outlet check valves.

56. The method of claim 55 wherein said control means sends a close signal to said outlet valve, and said control means receives a first set of pressure values from said first pressure measuring device and a second set of pressure values from said second pressure measuring device and compares said values to determine defects.

* * * * *